US007605763B2

(12) United States Patent
Finn et al.

(10) Patent No.: US 7,605,763 B2
(45) Date of Patent: Oct. 20, 2009

(54) COMBINATION ANTENNA WITH MULTIPLE FEED POINTS

(75) Inventors: Larry William Finn, Georgetown, TX (US); Dennis Andre Burrell, Round Rock, TX (US); Johnny C. Fraga, Round Rock, TX (US); Leo Joseph Gerten, Pflugerville, TX (US); James Roe Utz, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 380 days.

(21) Appl. No.: 11/227,402

(22) Filed: Sep. 15, 2005

(65) Prior Publication Data

US 2007/0060222 A1 Mar. 15, 2007

(51) Int. Cl.
*H01Q 1/24* (2006.01)

(52) U.S. Cl. ..... 343/702

(58) Field of Classification Search ..... 343/702, 343/700 MS

See application file for complete search history.

(56) References Cited

U.S. PATENT DOCUMENTS 6,069,587 A 5/2000 Lynch et al.
6,429,819 B1 8/2002 Bishop et al.
6,448,932 B1 9/2002 Stoiljkovic et al.
6,476,769 B1 11/2002 Lehtola
6,483,463 B2 11/2002 Kadambi et al.
6,507,322 B2 1/2003 Fang et al.
6,538,606 B2 3/2003 Quinn et al.
6,549,170 B1 4/2003 Kuo et al.
6,621,458 B1 9/2003 Petros et al.
6,661,388 B2 12/2003 Desargent et al.
6,667,719 B2 12/2003 LaKomski
6,778,844 B2 8/2004 Hood, III
6,806,838 B2 10/2004 Petros et al.
6,809,689 B1 10/2004 Chen
6,950,071 B2 * 9/2005 Wen et al. ..... 343/702
7,242,353 B2 * 7/2007 Hung et al. ..... 343/702
2002/0089454 A1 7/2002 Eggleston et al.
2002/0140612 A1 10/2002 Kadambi et al.

(Continued)

FOREIGN PATENT DOCUMENTS

CN 1635663 7/2005

(Continued)

OTHER PUBLICATIONS

Australian Search Report issued by Australian Patent Office, Dec. 15, 2006, Application No. 2006201098.

(Continued)

*Primary Examiner*—Trinh V Dinh
*Assistant Examiner*—Dieu Hien T Duong
(74) *Attorney, Agent, or Firm*—Haynes and Boone, LLP

(57) ABSTRACT

A combination antenna provides a common structure to combine a first electromagnetic radiation element and a second electromagnetic radiation element. The first electromagnetic radiation element and the second electromagnetic radiation element are tuned to operate independently and simultaneously over a first and second frequency band respectively. The common structure, which includes a common antenna structure, a common mounting structure and a common ground structure, saves space compared to a combined space occupied by the first electromagnetic radiation element and the second electromagnetic radiation element mounted separately as independent antennas.

5 Claims, 5 Drawing Sheets

U.S. PATENT DOCUMENTS

| | | | |
|---|---|---|---|
| 2002/0183013 | A1 | 12/2002 | Auckland et al. |
| 2002/0190905 | A1 | 12/2002 | Flint et al. |
| 2003/0050032 | A1 | 3/2003 | Masaki |
| 2003/0063032 | A1 | 4/2003 | Usui et al. |
| 2003/0103005 | A1 | 6/2003 | Cheng |
| 2003/0124985 | A1 | 7/2003 | Shin et al. |
| 2003/0234742 | A1 | 12/2003 | Tai et al. |
| 2004/0090378 | A1 | 5/2004 | Dai et al. |
| 2004/0135730 | A1 | 7/2004 | Yang |
| 2004/0178957 | A1 | 9/2004 | Chang et al. |
| 2004/0183732 | A1 | 9/2004 | Konishi et al. |
| 2004/0196191 | A1 | 10/2004 | Hung et al. |
| 2004/0198293 | A1 | 10/2004 | Sadler et al. |
| 2004/0246188 | A1 | 12/2004 | Egashira |
| 2005/0007279 | A1 | 1/2005 | Chang |
| 2005/0035911 | A1 | 2/2005 | Cheng et al. |
| 2005/0078039 | A1 | 4/2005 | Harano |
| 2005/0104788 | A1 | 5/2005 | Hung et al. |
| 2005/0195119 | A1 | 9/2005 | Gaucher et al. |
| 2005/0200545 | A1 | 9/2005 | Bancroft |
| 2005/0285802 | A1 | 12/2005 | Chung |

FOREIGN PATENT DOCUMENTS

| | | | |
|---|---|---|---|
| EP | 1 189 304 | A2 | 3/2002 |
| EP | 1 189 304 | A3 | 3/2002 |
| EP | 1 294 048 | A3 | 3/2003 |
| EP | 1475859 | | 11/2004 |
| EP | 1 569 300 | A1 | 8/2005 |
| GB | 2 157 500 | A | 10/1985 |
| GB | 2392563 | | 11/2004 |
| GB | 2 404 791 | | 2/2005 |
| JP | 11150415 | | 6/1999 |
| JP | 11150415 | A | 6/1999 |
| JP | 2003-8325 | | 1/2003 |
| JP | 2003-8342 | | 1/2003 |
| JP | 2003 298329 | | 10/2003 |
| JP | 2003 318639 | | 11/2003 |
| JP | 2004 128742 | | 4/2004 |
| JP | 2005 5780 | | 1/2005 |
| KR | 20020095760 | | 12/2002 |
| KR | 20050055032 | | 6/2005 |
| TW | 557603 | A | 10/2003 |
| TW | 227576 | B1 | 2/2005 |
| WO | WO 96/35241 | | 11/1996 |
| WO | WO 97/37399 | | 10/1997 |
| WO | WO 00/54367 | | 9/2000 |
| WO | WO 01/35491 | A1 | 5/2001 |
| WO | WO 01/37370 | | 5/2001 |
| WO | 0165636 | A1 | 9/2001 |
| WO | 0205382 | A1 | 1/2002 |
| WO | 02078123 | A1 | 10/2002 |
| WO | 2004021510 | | 3/2004 |
| WO | WO 2004/030143 | | 4/2004 |
| WO | 2004038857 | A1 | 5/2004 |
| WO | WO2005/034283 | A2 | 4/2005 |

OTHER PUBLICATIONS

Korean Search Report (English translation) issued by Korean Patent Office, Application No. 2006-0019273.

Written Opinion and Search Report, Singapore Application No. 200601013-6, issued by Australian Patent Office, Aug. 25, 2006.

http://catalog.tycoelectronics.com, Catalog 1773105, Antennas.

Combined Search and Examination Report, GB Application No. 0604482.0, issued by British Patent Office, Jun. 7, 2006.

Office Action issued from Japan Patent Office in corresponding Japanese Application No. 2006-123842, Feb. 19, 2005.

Examination Report issued from the UK Intellectual Property Office in corresponding GB Application No. 0604482.0, Apr. 21, 2008.

Search and Examination Report issued from the UK Intellectual Property Office in corresponding GB Application No. 0800490.5, Apr. 21, 2008.

Office Action issued by the Japanese Patent Office mailed Feb. 24, 2009, Japanese Patent Application No. 2006-123842.

Combined Search and Examination Report issued from the British Patent Office in corresponding Great Britain Patent Application No. 0819099.3, Nov. 19, 2008.

Office Action issued from the British Patent Office in corresponding Great Britain Patent Application No. 0604482.0, Nov. 19, 2008.

Office issued from the British Patent Office in corresponding Great Britain Patent Application No. 0800490.5, Nov. 19, 2008.

Office Action issued in corresponding German Patent Application No. 102006007452.1-55, Apr. 29, 2009.

* cited by examiner

COMBINATION ANTENNA WITH MULTIPLE FEED POINTS

BACKGROUND

The present disclosure relates generally to information handling systems, and more particularly to antenna systems used in wireless communications.

As the value and use of information continues to increase, individuals and businesses seek additional ways to acquire, process and store information. One option available to users is information handling systems. An information handling system ('IHS') generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Presently, use of wireless local area networks (LAN's) has experienced rapid growth since wireless technology when used with portable IHS devices combine information accessibility with user mobility. Many of these IHS's, especially the portable ones such as notebook computers, personal digital assistants (PDA's), cellular phones and gaming/entertainment devices, typically use various wireless peripheral devices such as radios and wireless network interface cards (NIC's) to communicate between themselves and/or with other wired or wireless networks, including intranets and the Internet. Wireless communication technologies continue to evolve and mature. Currently available wireless communication technologies include: wireless personal area networks (WPAN), wireless local area networks (WLAN), and wireless wide area networks (WWAN).

Multiple technological standards may be adopted for use in wireless communication networks. For example, IEEE 802.11, Bluetooth, Global System for Mobile Communications (GSM), and Infrared Data Association (IrDA) are widely accepted standards for wireless communications. Regardless of the standard used, wireless devices typically operate in certain predefined frequency spectrum.

Each radio device within a wireless communication system typically includes one or more antenna's to receive and/or transmit signals. The particular types of antennas or antenna systems deployed within an IHS are customized for each wireless application and are generally dependent on factors such as the communication standard, frequency range, data throughput, distance, power level, minimum quality of service (QOS) criteria and similar others.

FIG. 1 illustrates a schematic view of a layout arrangement for multiple antennas within a portable computer system, according to prior art. Generally, all antennas are optimised to work inside a periphery of the plastic enclosure of the portable computer system. The selected location for the multiple antennas may affect antenna performance. For example, antennas mounted on the top of the liquid crystal display (LCD) display unit may deliver better performance compared to antennas mounted on either side of or at the base of the LCD display unit. Since portable computers typically deploy separate antennas for each wireless function, adding new antennas to an already densely packaged and overcrowded space within the portable computer may be difficult. The rapid adoption of newer wireless communication standards such as WWAN, WLAN, and Bluetooth, may accelerate the overcrowding problem within the portable computer system. In addition, an improper positioning of the antenna(s) may limit the performance of the wireless devices. In some cases, multiple antennas may be shared by wireless devices through the use of a radio frequency (RF) switch (not shown). However, this technique generally does not permit simultaneous operation of all wireless devices and may result in increased cost due to the addition of the RF switch.

Therefore, a need exists to provide an improved method and system for accommodating a plurality of antennas within an IHS. Additionally, a need exists to house the plurality of antennas preferably without utilizing additional space within the IHS and preferably without a substantial increase in the cost of the product. Accordingly, it would be desirable to provide an improved antenna structure coupled to a radio device of an information handling system absent the disadvantages found in the prior methods discussed above.

SUMMARY

The foregoing need is addressed by the teachings of the present disclosure, which relates to a system and method for accommodating a plurality of antennas within a predefined space. According to one embodiment, a common antenna structure includes a first electromagnetic radiation element tuned to operate over a first frequency band; a second electromagnetic radiation element tuned to operate over a second frequency band; and a common structure shared by the first electromagnetic radiation element and the second electromagnetic radiation element, wherein the common structure includes a common antenna structure, a common mounting structure and a common ground structure.

Several advantages are achieved by the method and system according to the illustrative embodiments presented herein. The embodiments advantageously provide for an improved technique to accommodate a plurality of antennas concurrently operating over a plurality of frequency bands within a limited space. The improved technique also lowers the cost of the product by sharing one or more components between the plurality of antennas. Thus, newer wireless standards may be easily integrated without an increase in space.

DETAILED DESCRIPTION

Figure 1:
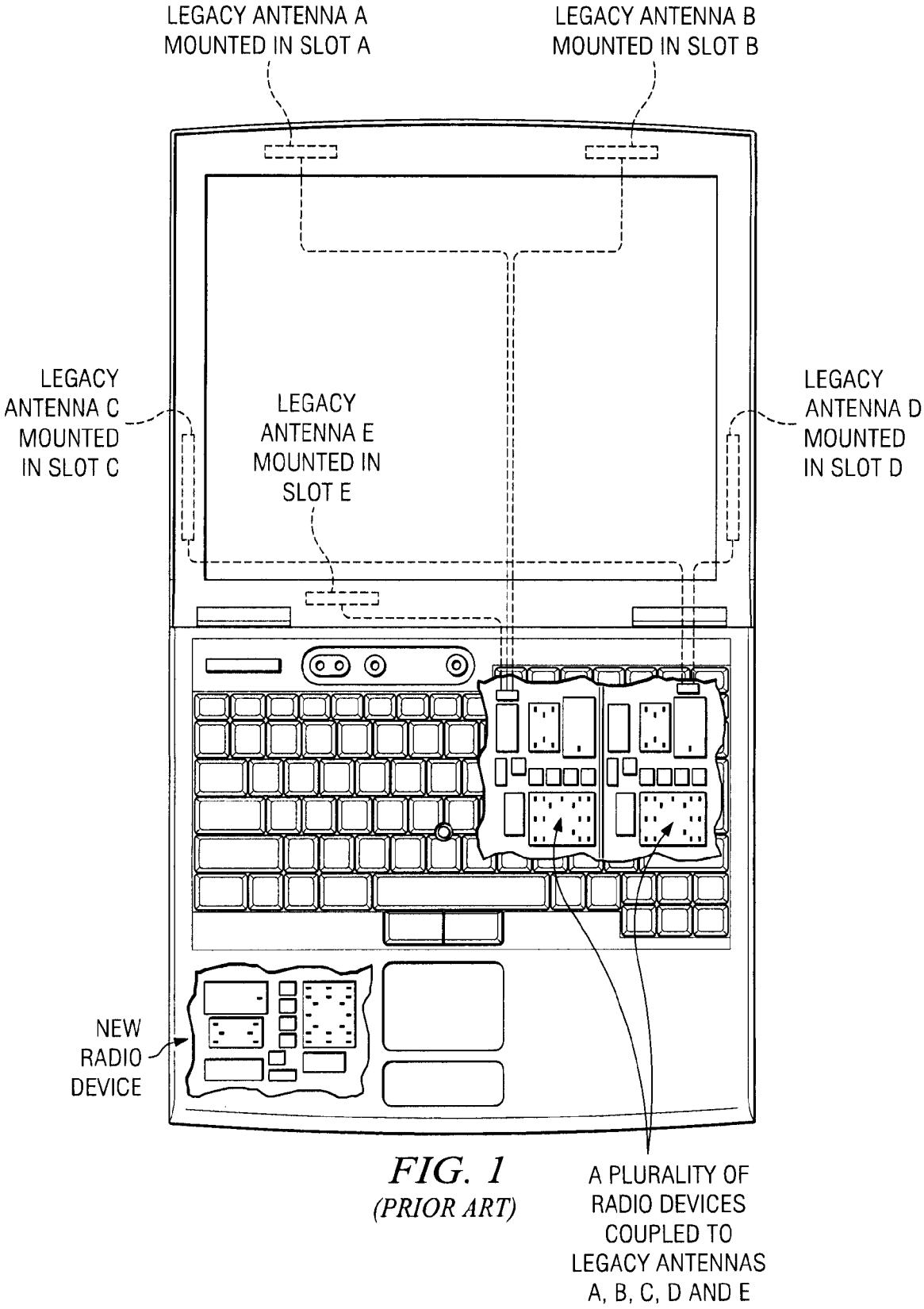
FIG. 1 (PRIOR ART)
FIG. 1 illustrates a schematic view of a layout arrangement for multiple antennas within a portable computer system, described herein above, according to prior art.

Novel features believed characteristic of the present disclosure are set forth in the appended claims. The disclosure itself, however, as well as a preferred mode of use, various objectives and advantages thereof, will best be understood by reference to the following detailed description of an illustrative embodiment when read in conjunction with the accompanying drawings. The functionality of various circuits, devices, boards, cards, and/or components described herein may be implemented as hardware (including discrete components, integrated circuits and systems-on-a-chip 'SOC'), firmware (including application specific integrated circuits and programmable chips) and/or software or a combination thereof, depending on the application requirements.

The following terminology may be useful in understanding the present disclosure. It is to be understood that the terminology described herein is for the purpose of description and should not be regarded as limiting.

Device—Any machine or component, which is electrically coupled to an IHS to perform at least one predefined function. Examples of devices include power supplies, fan assemblies, chargers, controllers, disk drives, scanners, printers, card readers, keyboards, and communication interfaces. Many devices may require a software program called a device driver program that acts as a translator between an application program and the device, or between a user and the device.

Radio—A communications device. The radio typically enables bi-directional communications between two devices. The radio, which may be wired or wireless, generally includes hardware, firmware, driver software and user interface and/or a combination thereof. The radio may be integrated with an IHS such as a notebook or PDA to enable wired or wireless communication between the IHS and external devices.

Antenna—A device for transmitting and/or receiving electromagnetic energy radiated at radio frequencies. A transmitting antenna converts electrical current into electromagnetic energy and a receiving antenna converts electromagnetic energy into electrical currents. Most antennas are resonant devices, which operate over at least one predefined frequency band. An arrangement of one or more antennas operating over the predefined frequency band(s) may be described as an antenna system. An antenna is typically tuned to the same frequency band as the radio device it is coupled to. A mismatch between the radio device and the antenna may result in an impaired reception and/or transmission.

Computer systems typically deploy separate antennas for implementing each wireless function. Thus, adding new antennas to support new and/or additional frequency bands may be difficult due to space limitations within the computers, especially in portable computers which are already densely packaged and have an overcrowded space. The rapid adoption of newer wireless communication standards may accelerate the overcrowding problem within the portable computer system. Presently, no tools and/or techniques exist to accommodate multiple antennas while conserving space within portable computers. As a result, users may have a limited choice while selecting wireless systems with multiple antennas. Thus, there is a need for an improved technique to accommodate multiple antennas while conserving space within portable computers.

According to one embodiment, in a method and system for accommodating a plurality of antennas, a combination antenna provides a common structure to combine a first electromagnetic radiation element and a second electromagnetic radiation element. The first electromagnetic radiation element and the second electromagnetic radiation element are tuned to operate independently and simultaneously over a first and second frequency band respectively. The common structure, which includes a common antenna structure, a common mounting structure and a common ground structure, saves space compared to a combined space occupied by the first electromagnetic radiation element and the second electromagnetic radiation element mounted separately as independent antennas.

For purposes of this disclosure, an IHS may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, the IHS may be a personal computer, including notebook computers, personal digital assistants, cellular phones, gaming consoles, a network storage device, or any other suitable device and may vary in size, shape, performance, functionality, and price. The information handling system may include random access memory (RAM), one or more processing resources such as central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Figure 2:
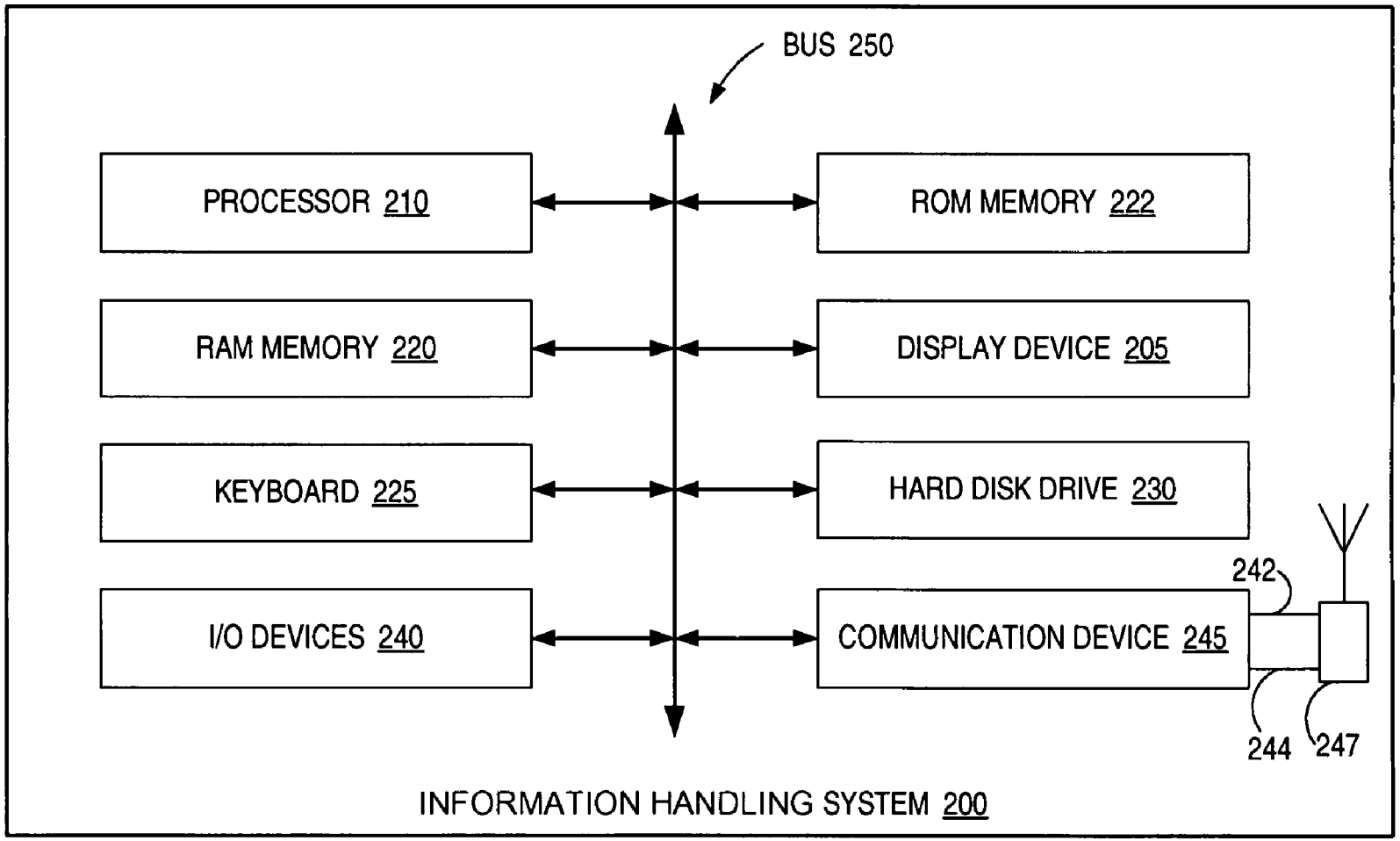
FIG. 2 illustrates a block diagram of an information handling system 200 having an improved antenna, according to an embodiment.

FIG. 2 illustrates a block diagram of an information handling system 200 having an improved antenna, according to an embodiment. The information handling system 200 having an improved antenna 247 includes a processor 210, a system random access memory (RAM) 220 (also referred to as main memory), a non-volatile ROM 222 memory, a display device 205, a keyboard 225 and an I/O controller 240 for controlling various other input/output devices. For example, the I/O controller 240 may include a keyboard controller, a memory storage drive controller and/or the serial I/O controller. It should be understood that the term "information handling system" is intended to encompass any device having a processor that executes instructions from a memory medium.

The IHS 200 is shown to include a hard disk drive 230 connected to the processor 210 although some embodiments may not include the hard disk drive 230. The processor 210 communicates with the system components via a bus 250, which includes data, address and control lines. In one embodiment, the IHS 200 may include multiple instances of the bus 250. A communications device 245, such as a network interface card and/or a radio device, may be connected to the bus 250 to enable wired and/or wireless information exchange between the IHS 200 and other devices (not shown). In the depicted embodiment, the improved antenna 247 may be coupled to the communications device 245 via communication links or cables 242 and 244. In an exemplary, non-depicted embodiment, each one of the communications links 242 and 244 may be coupled to a separate communication device. In a particular embodiment, the IHS 200 is a portable computer system. Additional detail of the improved antenna 247 is described with reference to FIG. 3.

The processor 210 is operable to execute the computing instructions and/or operations of the IHS 200. The memory medium, e.g., RAM 220, preferably stores instructions (also known as a "software program") for implementing various embodiments of a method in accordance with the present disclosure. For example, in a particular software program, the processor 210 may direct the communication device 245 to communicate using a particular frequency band supported by the improved antenna 247. In various embodiments the instructions and/or software programs may be implemented in various ways, including procedure-based techniques, component-based techniques, and/or object-oriented techniques, among others. Specific examples include assembler, C, XML, C++ objects, Java and Microsoft Foundation Classes (MFC).

Figure 3:
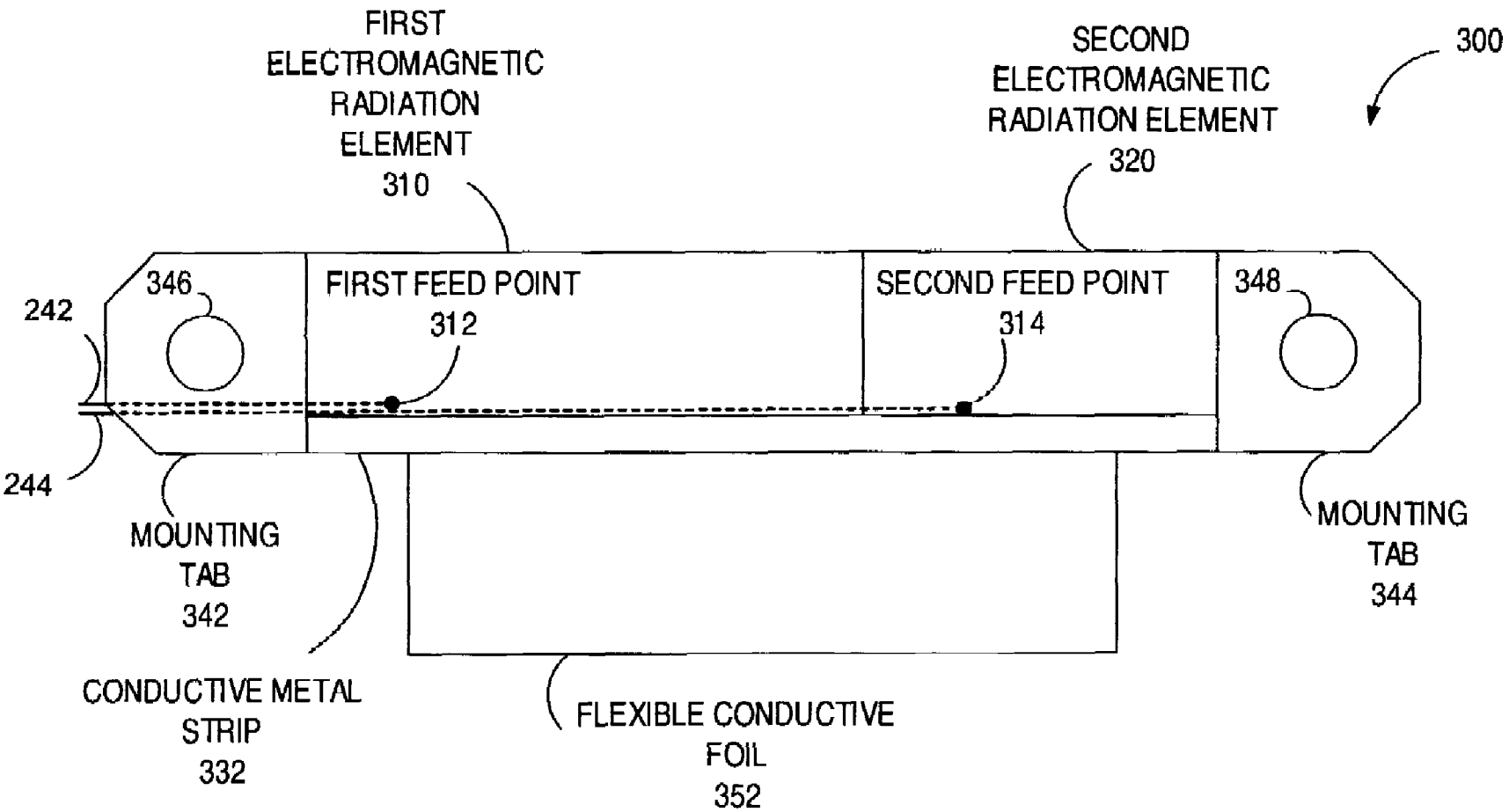
FIG. 3 illustrates a block diagram of a combination antenna, according to an embodiment.

FIG. 3 illustrates a block diagram of a combination antenna, according to an embodiment. In the depicted embodiment, an antenna assembly 300 includes a first electromagnetic radiation element 310 tuned to operate over a first frequency band, a second electromagnetic radiation element 320 tuned to operate over a second frequency band and a common structure, which is shared by the first electromagnetic radiation element 310 and the second electromagnetic radiation element 320. The common structure includes a common antenna structure, a common mounting structure and a common ground structure. Sharing of common functions such as structural support, mounting and ground between the multiple antennas advantageously contributes to a reduction in space occupied by the antenna assembly compared to legacy antennas having dedicated and hence duplicated common functions.

In the depicted embodiment, the first electromagnetic radiation element 310 is coupled to a first feed point 312 and the second electromagnetic radiation element 320 is coupled to a second feed point 314. The first electromagnetic radiation element 310 is tuned to receive and/or transmit radio frequency signals in the first frequency band via the first feed point 312. Similarly, the second electromagnetic radiation element 320 is tuned to receive and/or transmit radio frequency signals in the second frequency band respectively via the second feed point 314. In a non-depicted, exemplary embodiment, the antenna assembly 300 is substantially the same as the improved antenna 247 described with reference to FIG. 2. A radio device such as the communications device 245 is coupled to the antenna assembly 300 via cables 242 and 244, which are coupled to the first and second feed points 312 and 314 respectively. The operation of the first and second electromagnetic radiation elements 310 and 320 is independent of each other and may occur concurrently and/or simultaneously.

The size and shape of the first and second electromagnetic radiation elements 310 and 320 may vary depending on the selected frequency band in a wireless application. Typical structure for each one of the electromagnetic radiation elements 310 and 320 may include stub antenna, dipole antenna, patch antenna, slot antenna, inverted F antenna (INFA), yagi antenna, and similar others. The antenna elements may be stamped from a metal sheet or fabricated on a printed circuit board assembly. In a non-depicted, exemplary embodiment, the antenna assembly 300 is a multi-frequency band antenna and may include one or more electromagnetic radiation elements corresponding to each frequency band. In a non-depicted, exemplary embodiment, the size and shape of the antenna assembly 300 substantially resembles a rectangular prism having a length L 422, a height H 432 and a depth D 442. The exact dimensions may vary depending of the wireless application and the dimensions of the IHS 200.

In the depicted embodiment, the common antenna structure includes a conductive metal strip 332 which is a support frame for mounting the first and second electromagnetic radiation elements 310 and 320. The particular arrangement of the first and second electromagnetic radiation elements 310 and 320 facilitates a reduction and space and size occupied by the antenna assembly 300 compared to the space and size occupied by the first and second electromagnetic radiation elements 310 and 320 mounted separately in accordance with legacy antennas as described with reference to FIG. 1. In a non-depicted, exemplary embodiment, other forms of space saving common antenna structures, including 3-dimensional frames, are contemplated for supporting the first and second electromagnetic radiation elements 310 and 320 while reducing the overall space occupied by the antenna assembly 300. In a 3-dimensional arrangement, the first and second electromagnetic radiation elements 310 and 320 may overlap each others space.

At each end of the common antenna structure is a common mounting structure. In the depicted embodiment, the common mounting structure includes a pair of mounting tabs 342 and 344 located at each end of the conductive metal strip 332. Each one of the pair of mounting tabs 342 and 344 is conductive and has a corresponding punched-out hole 346 and 348. In a non-depicted, exemplary embodiment, the pair of holes 346 and 348 enables a screw at each end to 'removably secure' (secure in a removable manner) the first electromagnetic radiation element 310, the second electromagnetic radiation element 320, and the common structure to a portion of the IHS 200. Additional detail of mounting the antenna assembly 300 within the IHS 200 is described with reference to FIG. 4.

In the depicted embodiment, the common ground structure includes the conductive metal strip 332, and the pair of mounting tabs 342 and 344. In a non-depicted, exemplary embodiment, the common ground structure is coupled to a common ground reference in the IHS 200 via the pair of screws at each end. In a particular embodiment, the common ground structure may include a flexible conductive foil 352. The flexible conductive foil 352 provides additional coupling between the common ground structure and the common ground reference in the IHS 200 such as a metal body housing the LCD display.

Figure 4:
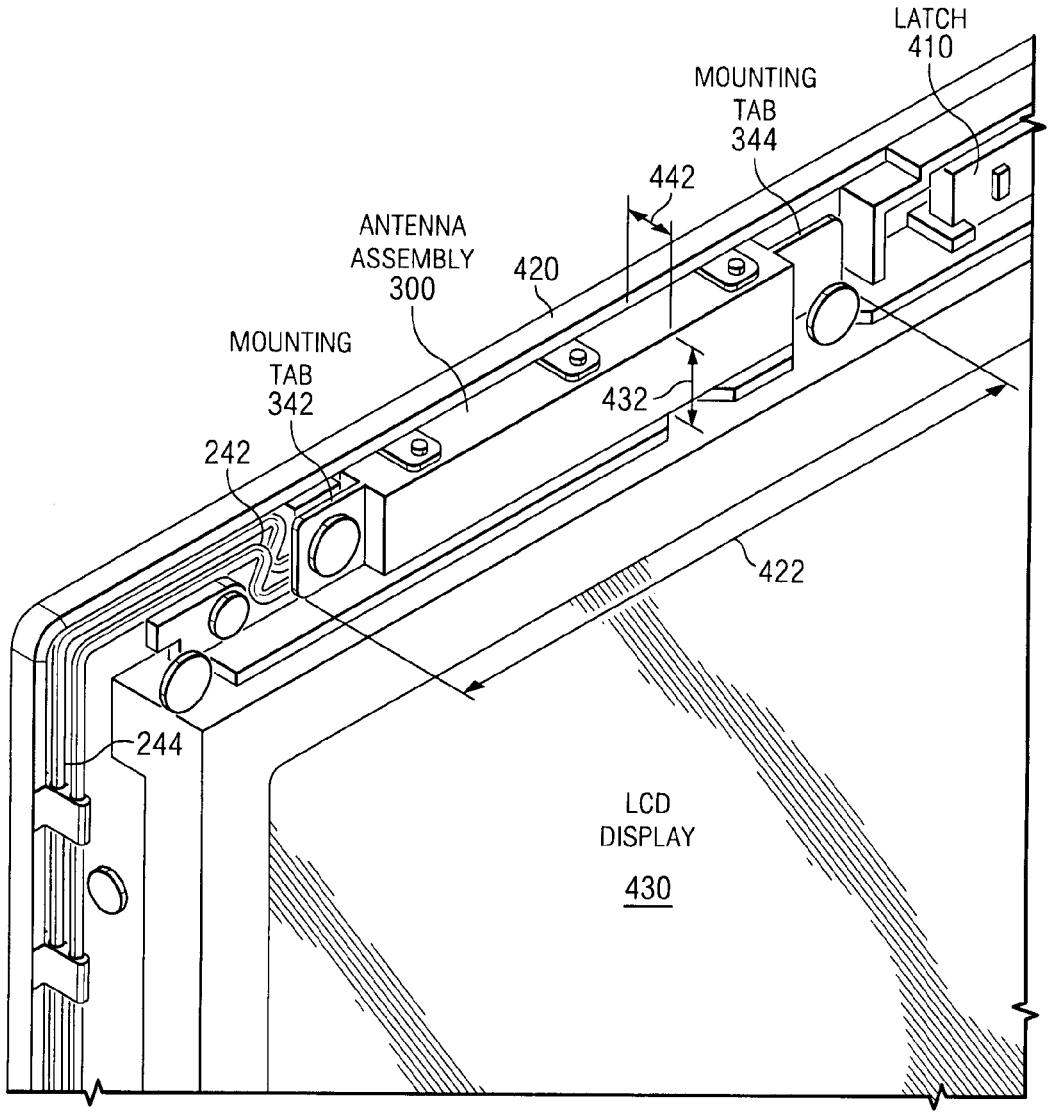
FIG. 4 illustrates an isometric view of an antenna assembly mounted within a portable information handling system, according to an embodiment.

FIG. 4 illustrates an isometric view of an antenna assembly mounted within a portable information handling system, according to an embodiment. In the depicted embodiment, the antenna assembly 300 (shown without the conductive foil 352) is located at one of the locations for the legacy antennas described with reference to FIG. 1. For example, the antenna assembly 300 is mounted within a gap, window or a slot located on either side of a latch assembly 410 and between a top peripheral edge 420 of the IHS 200 and an LCD display 430 used as the display screen 205. The cables 242 and 244 provide the RF signals to the first and second electromagnetic radiation elements (not shown). The form factor of the window or the slot housing the antenna assembly 300 substantially resembles a rectangular prism having predefined dimensions for a length 422, a height 432 and a depth 442. In a particular embodiment, the height 432 and the depth 442 is substantially the same as mounting slot for legacy antennas described with reference to FIG. 1. The length of the antenna assembly 300 may be greater than a length for each one of the first electromagnetic radiation element 310 and the second electromagnetic radiation element 320 when mounted in a legacy arrangement, e.g., separately as independent antennas. However, the length of the antenna assembly 300 is less than a combined length for the first electromagnetic radiation element 310 and the second electromagnetic radiation element 320 when mounted in the legacy arrangement. Thus, the antenna assembly 300 advantageously occupies less space compared to a combined space occupied by the first electromagnetic radiation element 310 and the second electromagnetic radiation element 320 when mounted separately as independent legacy antennas.

Figure 5:
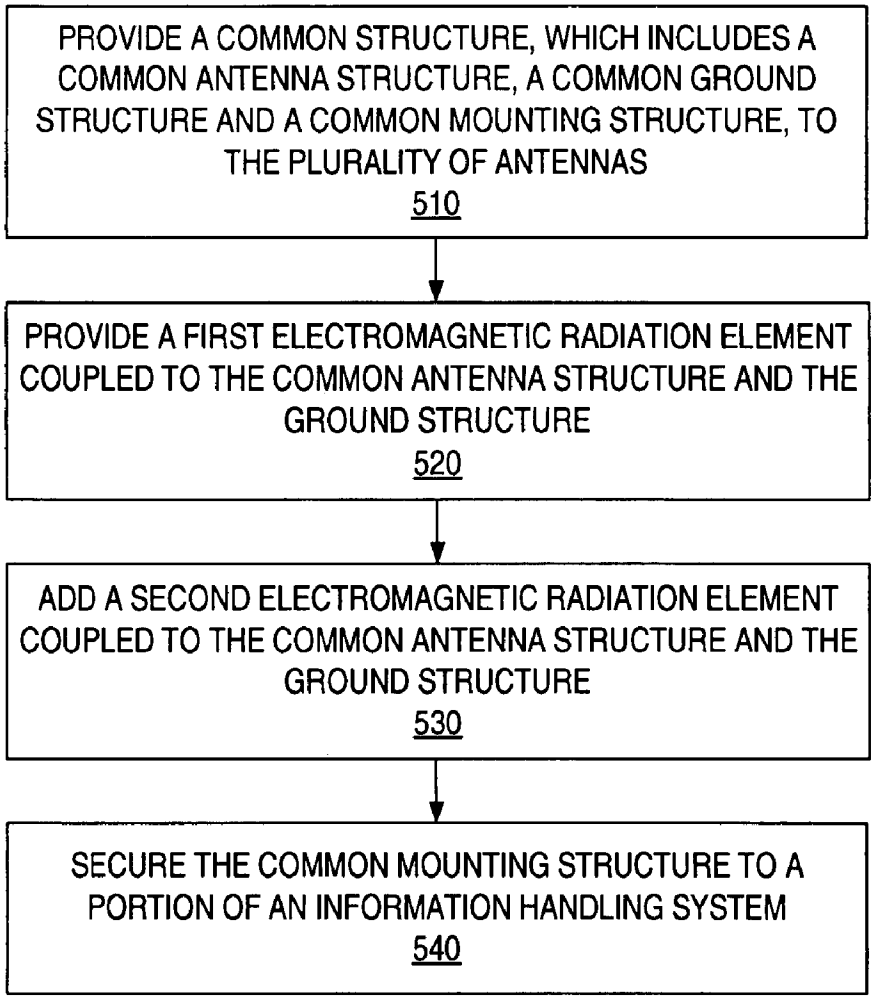
FIG. 5 is a flow chart illustrating a method for accommodating a plurality of antennas, according to an embodiment.

FIG. 5 is a flow chart illustrating a method for accommodating a plurality of antennas, according to an embodiment. In step 510, a common structure is provided to the plurality of the antennas. In one embodiment, the common structure for the plurality of the antennas includes a common antenna structure, a common mounting structure and a common ground structure. In step 520, a first electromagnetic radiation element, e.g., the first electromagnetic radiation element 310, tuned to operate over a first frequency band is provided and structurally coupled to the common antenna structure and electrically coupled to the common ground structure. In step 530, a second electromagnetic radiation element, e.g., the second electromagnetic radiation element 320, tuned to operate over a second frequency band is added by structurally coupling the second element to the common antenna structure and electrically coupling to the common ground structure. In step 540, the common mounting structure for the first electromagnetic radiation element and the second electromagnetic radiation element is secured in a removable manner, e.g., by screws, to a portion of a portable information handling system (IHS). Various steps described above may be added, omitted, combined, altered, or performed in different orders. For example, the steps 520 and 530 may be performed in parallel rather than in sequence.

Although illustrative embodiments have been shown and described, a wide range of modification, change and substitution is contemplated in the foregoing disclosure and in some instances, some features of the embodiments may be employed without a corresponding use of other features. Those of ordinary skill in the art will appreciate that the hardware and methods illustrated herein may vary depending on the implementation. For example, it should be understood that while the combined antenna is implemented using a portable IHS system, it would be within the spirit and scope of the invention to encompass an embodiment using any form of an IHS system deploying any wireless technology. As another example, while the combined antenna is implemented using two radiating elements having their respective feed points, it is contemplated to have a combined antenna having more than two radiating elements, with each radiating element having its respective feed point and the more than two radiating elements sharing a common structure.

The methods and systems described herein provide for an adaptable implementation. Although certain embodiments have been described using specific examples, it will be apparent to those skilled in the art that the invention is not limited to these few examples. The benefits, advantages, solutions to problems, and any element(s) that may cause any benefit, advantage, or solution to occur or become more pronounced are not to be construed as a critical, required, or an essential feature or element of the present disclosure.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A combination antenna comprising:

a common antenna structure; and a common ground structure including a single conductive metal strip and common mounting structure;

wherein the common antenna structure mounted in a portable information handling system (IHS), the common antenna structure being of a size suitable for mounting in a position adjacent a peripheral edge of an LCD portion of the IHS and a latch portion of the IHS, the common antenna structure including:

a first electromagnetic radiation element tuned to operate over a first frequency band and coupled to a first feed point;

a second electromagnetic radiation element tuned to operate over a second frequency band and coupled to a second feed point, said first and second electromagnetic radiation elements being substantially linear and in the same plane or a substantially parallel plane;

wherein the common mounting structure includes a mounting tab at each end of the conductive metal strip, said conductive metal strip supporting the first and second radiation elements, wherein the mounting tab further contacts to one end of the first radiation element or one end of the second radiation element respectively;

wherein said first and second radiation elements are capable of operating simultaneously with each other; and wherein the common ground structure further includes a flexible conductive foil, wherein the flexible conductive foil attaches to the conductive metal strip and extends downward away from the conductive metal strip.

2. The combination antenna of claim 1, wherein the first electromagnetic radiation element and the second electromagnetic radiation element operate independently of each other.

3. The combination antenna of claim 1, wherein the first electromagnetic radiation element and the second electromagnetic radiation element are tuned to receive and transmit radio frequency signals in the first frequency band and the second frequency band respectively.

4. An information handling system (IHS) comprising:

a processor;

a radio device coupled to the processor;

a common antenna structure; and a common ground structure including a single conductive metal strip and a common mounting structure;

wherein said common antenna structure mounted in the portable information handling system (IHS), in a position adjacent a peripheral edge of an LCD portion of the IHS and a latch portion of the IHS, the common antenna structure comprising:

a first electromagnetic radiation element tuned to operate over a first frequency band of the radio device and coupled to a first feed point;

a second electromagnetic radiation element tuned to operate over a second frequency band of the radio device and coupled to a second feed point;

wherein the common mounting structure includes a mounting tab at each end of the conductive metal strip, said conductive metal strip suporting the first and the second radiation elements, wherein the mounting tab further contacts to one end of the first radiation element or one end of the second radiation element respectively;

wherein said first and second electromagnetic radiation elements are substantially linear and in the same or substantially parallel planes and, wherein said first and second electromagnetic radiation elements are capable of operating simultaneously; and wherein the common ground structure further includes a flexible conductive foil, wherein the flexible conductive foil attaches to the conductive metal strip and extends downward away from the conductive metal strip.

5. The system of claim 4, wherein the common ground structure provides a ground reference between the common antenna structure, the processor and the radio device.

* * * * *

UNITED STATES PATENT AND TRADEMARK OFFICE

CERTIFICATE OF CORRECTION

PATENT NO. : 7,605,763 B2
APPLICATION NO. : 11/227402
DATED : October 20, 2009
INVENTOR(S) : Finn et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 411 days.

Signed and Sealed this

Fifth Day of October, 2010

David J. Kappos

David J. Kappos
*Director of the United States Patent and Trademark Office*